United States Patent [19]

Santilli

[11] 4,052,325

[45] Oct. 4, 1977

[54] LIQUID ELECTROGRAPHIC DEVELOPER COMPOSITION CONTAINING REDISPERSIBLE POLYESTER TONER AND PROCESS

[75] Inventor: Domenic Santilli, Webster, N.Y.

[73] Assignee: Eastman Kodak Company, Rochester, N.Y.

[21] Appl. No.: 700,249

[22] Filed: June 28, 1976

Related U.S. Application Data

[63] Continuation-in-part of Ser. No. 535,618, Dec. 23, 1974, abandoned.

[51] Int. Cl.[2] ..... G03G 9/12

[52] U.S. Cl. ..... 252/62.1 L; 96/1 LY; 260/22 R; 260/40 R; 260/49; 260/75 R; 427/15; 427/17; 427/22

[58] Field of Search ..... 260/75 R, 49, 22 R, 260/40 R; 252/62.1 L, 62.1 R; 427/15, 17, 22; 96/1 LY

[56] References Cited

U.S. PATENT DOCUMENTS

| | | | |
|---|---|---|---|
| 2,899,335 | 8/1959 | Straughan | 117/37 |
| 3,391,014 | 7/1968 | Fauser | 252/62.1 L |
| 3,546,180 | 12/1970 | Caldwell et al. | 260/49 |
| 3,557,691 | 1/1971 | Bayer | 252/62.1 |
| 3,590,000 | 6/1971 | Palermiti et al. | 252/62.1 |
| 3,668,127 | 6/1972 | Machida | 252/62.1 |
| 3,826,747 | 7/1974 | Nagashima et al. | 252/62.1 L |
| 3,856,692 | 12/1974 | Mammino et al. | 252/62.1 L |

FOREIGN PATENT DOCUMENTS

| | | |
|---|---|---|
| 793,247 | 12/1972 | Belgium |
| 1,266,545 | 3/1972 | United Kingdom |

*Primary Examiner*—Mayer Weinblatt
*Assistant Examiner*—John D. Smith
*Attorney, Agent, or Firm*—George W. Neuner

[57] ABSTRACT

A liquid developer containing redispersible, readily heat-fixable toner particles and a process for using the same. The developer is characterized by toner particles containing certain linear polyesters which are physically inert to the liquid carrier vehicle of the liquid developer and which, advantageously, have a melting point in the range of from about 40° to about 150° C.

10 Claims, No Drawings

LIQUID ELECTROGRAPHIC DEVELOPER COMPOSITION CONTAINING REDISPERSIBLE POLYESTER TONER AND PROCESS

This application is a continuation-in-part of co-pending application Ser. No. 535,618, filed Dec. 23, 1974 in the name of Domenic Santilli, which is now abandoned.

FIELD OF THE INVENTION

This invention relates to electrography and more particularly to novel liquid developer compositions and their use in the development of electrostatic charge patterns.

BACKGROUND OF THE INVENTION

Electrographic imaging and development processes, e.g., electrophotographic imaging processes and techniques, have been extensively described in both the patent and other literature, for example, U.S. Pat. No. 2,221,776, issued Nov. 19, 1940; U.S. Pat. No. 2,277,013, issued Mar. 17, 1942; U.S. Pat. No. 2,297,691, issued Oct. 6, 1942; U.S. Pat. No. 2,357,809, issued Sept. 12, 1944; U.S. Pat. No. 2,551,582, issued May 8, 1951; U.S. Pat. No.2,825,814, issued Mar. 4, 1958; U.S. Pat. No. 2,833,648, issued May 6, 1958; U.S. Pat. No. 3,220,324, issued Nov. 30, 1965; U.S. Pat. No. 3,220,831, issued Nov. 30, 1965; U.S. Pat. No. 3,220,833, issued Nov. 30, 1965, and many others. Generally, these processes have in common the steps of forming a latent electrostatic charge image on an insulating electrographic element, such as a photoconductive insulating layer coated on a conductive support. The electrostatic latent image is then rendered visible by a development step in which the charge image-bearing surface of the electrographic element is brought into contact with a suitable developer composition.

Many types of developer compositions, including both dry developer compositions and liquid developer compositions, have been proposed heretofore for use in the development of latent electrostatic charge images. Dry developer compositions typically suffer from the disadvantage that distribution of the dry toner powder contained therein on the surface of the electrographic element bearing the electrostatic latent image is difficult to control. These dry developers have the further disadvantage that the use thereof may create excessive amounts of dust and that high resolution is often difficult to obtain due to the generally relatively large size of the dry developer powder particles.

Many of the disadvantages accompanying the use of dry developer compositions have been avoided in the past by the use of a liquid developer of the type described, for example, in Metcalfe et al, U.S. Pat. No. 2,907,674 issued Aug. 6, 1959. Such developers usually comprise an electrically insulating liquid which serves as a carrier and which contains a stable dispersion of charged particles known as toner particles comprising a pigment such as carbon black, generally associated with a resinous binder, such as, for example, an alkyd resin. A charge control agent is often included to stabilize the magnitude and polarity of the charge on the toner particles. In some cases, the binder itself serves as a charge control agent.

To achieve suitable physical stability of the toner particles dispersed in conventional liquid electrographic developers, any of several types of various "stabilization" additives are incorporated in such a liquid developer to prevent the toner particles from settling out of the carrier liquid. Typical of such additives are those described in York, U.S. Pat. No. 2,899,335 issued Aug. 11, 1955 and various types of dispersants as described, for example, in British Pat. No. 1,065,796.

One problem which has continued to persist with conventional "stabilized" liquid electrographic developer compositions as described above is that even these "stabilized" compositions, which contain various kinds of stabilization additives, tend to become "deactivated" within a few weeks and the toner particles tend to agglomerate or settle out of the developer. As a consequence, the resultant liquid developer composition containing conventional liquid developer toner particles tends to become incapable of producing electrostatic prints of good quality and density. (See British Pat. No. 1,065,796 noted above). This deactivation of conventional stabilized liquid developers is particularly troublesome because once the toner particles settle out of the developer suspension, it is often difficult to redisperse them. And, even if redispersed, it is often found that the redispersed liquid developer does not possess the same developer characteristics as the original developer.

Developer stability, even in conventional so-called "stabilized" liquid developers has been and is still a difficult problem to overcome. This is one reason, in addition to convenience, that liquid developers are often prepared in the form of so-called"concentrates" i.e., mixtures of resins, pigments and/or dyes with a low liquid content. These concentrates are stable and exhibit a relatively long shelf life. The loss of "stability" which occurs in conventional liquid electrographic developers, as noted hereinabove, occurs primarily in the diluted form of the concentrate which is the "working" form of the developer, i.e., the form of developer composition actually used in most electrographic developing processes.

Stability in "working" liquid developer compositions may be improved to some extent, as noted above in the afore-mentioned York patent, by the use of various stabilization agents. These additives are most effective in a developer when used in conjunction with toner particles having a very small particle size. However, even in these situations where stability is achieved in working developers, this stability is often accompanied by too high a developer sensitivity which tends to result in a high degree of background density in the resultant liquid developed electrographic images.

A further problem associated with conventional "stabilized" liquid developers has been the problem of replenishment. That is, once the developer is used to produce a number of developed images, the developer becomes depleted of toner particles and must be replenished. However, as might be expected in any dispersed system wherein a delicate equilibrium must necessarily be maintained to avoid settling out or precipitation of the dispersed particles, replenishment by injecting new particles into the suspension is a particularly complex problem.

In addition to the "stabilized" liquid developers described above, various "redispersible" liquid developers have been formulated. These "redispersible" developers are characterized by toner particles which, upon settling out of suspension with the liquid carrier vehicle of the developer, are readily redispersed in the liquid carrier and, when so redispersed, exhibit developer characteristics similar to the original developer. However, various problems still exist with many of these "redispersible" developers. For example, the toner particles of many of these developers do not adhere well, i.e., they cannot readily be fixed, except to rough-surfaced toner-image receiving sheets such as conventional zinc oxide coated papers, using preferred fixing temperatures of about 100° C. or less. These developers, therefore, cannot be employed, except with further binder addenda, in various transfer processes such as many of the so-called TESI processes (as described in "Electrophotography" by R. M. Schaffert, p. 67–p. 85, The Focal Press, 1965), because these processes use smooth-surfaced toner-image receiving elements, such as dielectric resin-coated papers, i.e., papers coated with a film-forming dielectric resin. Still other available redispersible developers, although redispersible at ordinary room temperatures, exhibit pronounced caking or agglomeration of the toner particles when subjected to extended periods of storage (e.g., 24 hours) at temperatures above room temperature, i.e., at about 55°–60° C., and cannot be readily redispersed.

SUMMARY OF THE INVENTION

In accord with the present invention there is provided an improved liquid developer composition comprising a suitable liquid carrier vehicle in which are dispersed heat-fixable, electrostatically-attractable toner particles comprising as a binder component thereof certain linear polyesters, as described hereinafter, which are physically inert in the carrier liquid. The toner particles contained in liquid developers of the present invention are characterized by their ready heat-fixability to a smooth-surfaced receiving element and by their ease, upon settling out of the liquid carrier vehicle, of being redispersed in the liquid carrier. The aforementioned linear polyesters are present in the liquid developer of the invention in an amount greater than 0.05 weight percent based on the total weight of the developer composition and, as indicated above, serve as a binder component of the developer, i.e., a component of the developer used to fix the toner particles to the toner-image receiving element.

Certain insoluble polymeric materials have been used heretofore as the binder component of the toner particles of liquid developer compositions, for example, certain of the polyamides described in Straughan, U.S. Pat. No. 2,899,335, Aug. 11, 1959. In addition, certain types of polymers containing ester groups have been proposed for use in various kinds of liquid developers. For example, liquid developers containing an insulating organic solvent and an oil-soluble, surface-active copolymer which may contain ester groups derived from unsaturated acids (e.g., fumaric acid) are described in British Pat. No. 1,266,545 dated Mar. 8, 1972. In addition, U.S. Pat. No. 3,668,127 issued June 6, 1972 describes liquid developers containing an insulating carrier liquid and pigment-containing toner particles bearing at least two polymer coatings, namely, an inner polymer coating insoluble in the carrier liquid (e.g., a styrene-butylmethacrylate copolymer) and an outer polymer coating partially soluble in the carrier liquid.

Perhaps the closest the art has come to the improved, liquid developers of the invention is in the formulation of certain commercially available, redispersible liquid developers which, upon analysis, have been found to contain as the binder component thereof various drying oils which are soluble in the carrier vehicle of the developer. These prior art liquid developers also appear to contain a very small amount of a polymer consisting of a mixed isophthalateterephthalate ester (i.e., an amount equal to about 0.001 weight percent based on the total weight of the working strength developer in association with the colorant material of the developer. The precise reason(s) this small amount of the aforementioned mixed-ester polymer is present in such redispersible developers is not known although it may be present simply as a polymeric component used to modify or enhance certain properties of the pigments used in these developers.

The aforementioned mixed-ester polymer appears to be similar and may be identical to certain of the non-crystalline members of the class of linear polyesters described hereinafter for use as the binder component of the liquid developers of the present invention. Of course, the function of these polyesters as the binder component in the developers of the present invention appears to be quite different from the unknown function of the apparently similar or identical materials used in the prior art. Indicative of this fact is that the working strength developers of the present invention contain, at a minimum, 50 times more of these mixed ester polymers than is used by the prior art developers, i.e., 0.05 weight percent compared to about 0.001 weight percent; and further that the liquid developers of the present invention exhibit good fixing properties, even to smooth-surfaced receiver elements, without the need for a separate fixing component soluble in the liquid carrier vehicle of the developer, such as a drying oil, whereas the aforementioned prior art developers do employ, as an essential component, a separate soluble, fixing component to achieve fixing of the toner images formed by these prior art developers. Thus, it does not appear that the linear polyesters having the properties described more specifically hereinafter have been used as the binder component of liquid developers. And, accordingly, the art does not appear to have recognized the combination of advantageous properties, such as redispersibility and fusibility, which the liquid developers of the invention are capable of providing.

Certain polyester materials or modified polyesters similar to or like those used in the present invention have been proposed for use in dry electrographic developers or in dry printing ink compositions, as in U.S. Pat. No. 3,557,691 issued Jan. 26, 1971; U.S. Pat. No. 3,590,000, issued June 29, 1971; and Belgian Pat. No. 793,247 dated June 22, 1973. However, these patents do not disclose or recognize the useful and unexpected advantages obtained by the present invention wherein certain linear polyesters are used as the binder component of liquid developer compositions.

DESCRIPTION OF THE PREFERRED EMBODIMENTS

One of the particularly noteworthy aspects of the liquid developer of the present invention is the ease with which the toner particles can be redispersed in the carrier liquid. In accord with the present invention there is provided a "redispersible" liquid developer which is highly practical and substantially avoids the difficult problems of developer stabilization and replenishment which must be faced with conventional "stabilized" liquid developers. That is, one need not worry about the toner particles settling out of the developer of the present invention during periods of little or no usage or during the replenishment thereof. With only a minimal amount of agitation, the toner particles of the present developer composition are readily redispersed within the carrier liquid and exhibit substantially the same developer properties as when first dispersed therein so that no noticeable loss in image quality results. This is true even though the toner particles contained in the liquid developer of the invention may have settled out and been redispersed a countless number of times between the first and last electrostatic charge pattern developed by the liquid developer of the present invention.

Another especially advantageous feature of the liquid developers of the present invention is that the polyester-containing toner particles thereof are physically inert with respect to the liquid carrier vehicle of the developers. That is, the toner particles, when dispersed in the liquid carrier vehicle of the developer, are hard and non-tacky and are not solubilized, softened, or swelled by the liquid carrier vehicle at ordinary room temperatures or at usual storage and operating liquid development temperatures. Therefore, one need not worry about "caking" or agglomeration of these toner particles when the developer is stored or subjected to periods of non-use, even under temperatures somewhat higher than ordinary room temperatures, i.e., up to about 55°-60° C., for extended periods up to 24 hours.

In addition, in accord with a further feature of the developers of the invention, the toner particles contained therein are characterized by relatively low melting points, preferably less than about 150° C, and therefore the developers of the invention required low energy levels for heat-fixing an image developed therewith to an image-bearing support. The liquid electrographic toners of this invention desirably have a melting point greater than room temperature and preferably above the highest temperature that the toners of this invention may experience for any extended period up to about 24 hours. Thus, the liquid electrographic toner of this invention desirably have a melting point in the range of from about 40° to about 150° C, and preferably in the range of from about 60° to about 100° C. Moreover, in accord with this embodiment of the invention, the polyester toner materials contained in the liquid developer fuse at an extremely rapid rate so that an image which is liquid developed using the developer of the present invention can be fixed very quickly.

In accord with a further especially useful embodiment of the present invention the polyester-containing toner particles of the developer not only possess a relatively low melting point, but in addition exhibit a relatively sharp melting range on the order of less than about 10° C. Such a sharp melting point range further enhances the heat-fixability of these toner particles to an image-bearing receiving sheet or support.

Still another advantage of the preferred liquid developers of the present invention is that they are readily fixed to even extremely smooth toner-image receiving elements, such as dielectric resin-coated papers, when heated to a temperature of about 100° C.

A "redispersable" liquid developer is defined in the present specification in terms of the following test: A first 25 ml. portion of a freshly prepared, working strength liquid developer containing about 99.85 weight percent of liquid carrier vehicle and about 0.15 weight percent of toner particles (the toner particles containing carbon as a colorant in an amount equal to about 0.5 g. of carbon per liter of developer) is used to develop a latent electrostatic charge pattern in a conventional liquid development electrophotographic process such as described in Metcalfe et al., U.S. Pat. No. 2,907,674. The resultant visible, liquid developed images are retained. A second 25 ml. portion of this freshly prepared developer is poured into a clear glass bottle which is capped with a clear glass stopper. This second portion of the developer is then allowed to stand at room temperature (i.e. 22° C.) at 50 percent relative humidity for a period of four weeks. At the end of this four week period, at least some of the toner particles dispersed in the developer will have settled out of the developer and be visible in the glass bottle in which the developer is stored. The bottle in which the developer is stored is then turned upside down and righted (i.e. inverted) two times over a 3 second time span, and the "settled-out" toner particles are redispersed in the developer. This redispersed developer is then used to develop a latent electrostatic charge pattern identical to that developed by the original, freshly prepared developer using a liquid development process identical to that in which the freshly prepared developer was employed. The resultant visible, liquid developed images possess an image quality substantially similar to that of the images produced from the freshly prepared developers as evaluated in terms of: optical density in the image areas; optical density in background, non-image areas; fine-line and solid-area image reproduction; and resolution capabilities.

Polyester resins have been suggested for use in liquid electrographic toners in, for example, U.S. Pat. No. 3,391,014 and U.S. Pat. No. 3,826,747. We have found that many polyesters when used to make liquid electrographic toners do not yield redispersible liquid toners such as the toners of this invention. For example, polycarbonates, alkyd resins such as Becktosol ® resins, low molecular weight crystalline polyesters such as poly(pentamethylene glutarate) and poly(neopentyl adipate), etc. do not make useful redispersible liquid toners.

The polyester materials contained in the toner particles of the liquid developers of the present invention and which are responsible for many of the advantageous properties of the present invention are thermoplastic, linear polymeric materials. In accord with a preferred embodiment of the invention these polyester materials are crystalline polymers. The polyesters used in the toner particles of the present invention have structural formula I:

$$(-O-R-O-\overset{O}{\overset{\|}{C}}-R^1-\overset{O}{\overset{\|}{C}}-)_{100-X}(-O-R^2-O-\overset{O}{\overset{\|}{C}}-R^3-\overset{O}{\overset{\|}{C}}-)_X \qquad \text{I.}$$

wherein X represents a mole percentage value within the range of 0 to 100 mole percent; R and $R^2$, which may be the same or different, represent the divalent residue of an aliphatic, alicyclic, or aromatic diol upon removal of the two hydroxy groups from said diol; $R^1$ represents the divalent residue of a sulfonamido-free aliphatic, alicyclic, or aromatic dicarboxylic acid upon removal of the two carboxyl groups from said acid; and $R^3$ represents a member selected from the same group as $R^1$ and may be the same as or different from $R^1$, or $R^3$ represents the divalent residue of a disulfonamido group-containing aromatic dicarboxylic acid upon removal of the two carboxyl groups from said acid, said disulfonamido group having a monovalent cation on the amido nitrogen atom. In an especially useful embodiment of the invention, $R^3$ in formula I above represents a member selected from the same group as $R^1$.

The diols, including aliphatic, alicyclic, and aromatic diols, which may be used in the preparation of the crystalline polyester contained in the toner particles of the liquid developers of the present invention may be selected from a variety of known such diols. Useful diols which may be used to provide R and $R^2$ of Formula I include bisphenols, alkylene glycols, and monocyclic and polycyclic diols. Representative bisphenols which may be employed are generally of the structure of formula II:

II.

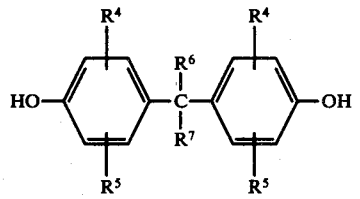

wherein each $R^4$ and $R^5$, which can be the same or different, are selected from the group consisting of hydrogen atoms, aryl radicals, such as phenyl, including substituted phenyl, halogen atoms, nitro radicals, cyano radicals, alkoxy radicals and the like, and wherein the substituents on the phenyl radical may be a halogen atom, nitro radical, cyano radical, or alkoxy radical. $R^6$ and $R^7$ represent aliphatic, moncyclic or bicyclic radicals and can each be hydrogen atoms; alkyl radicals of from 1 to 6 carbon atoms, including substituted alkyl radicals, such as fluoromethyl, difluoromethyl, trifluoromethyl, dichlorofluoromethyl, 2-[2,3,4,5-tetrahydro-2,2-dimethyl-4-oxofur-3-yl] ethyl and the like; cycloalkyl radicals of from 4 to 6 carbon atoms, such as cyclohexyl; and aromatic radicals having from 6 to 20 carbon atoms, such as phenyl, 3,4-dichlorophenyl, 2,4-dichlorophenyl. $R^6$ and $R^7$ taken together with the carbon atoms to which they are attached can represent a monocyclic, bicyclic, or heterocyclic moiety having from 4 to 7 atoms in the ring.

Typical useful bisphenols include: Bisphenol A; 2,2-bis(4-hydroxy-3,5-dichlorophenyl)propane[tetrachlorobisphenol A]; 1-phenyl-1,1-bis(4-hydroxyphenyl)ethane; 1-(3,4-dichlorophenyl)-1,1-bis(4-hydroxyphenyl)ethane; 2,2-bis(4-hydroxyphenyl)-4-[3-(2,3,4,5-tetrahydro-2,2-dimethyl-4-oxofuryl)]butane; bis(4-hydroxyphenyl)methane; 2,4-dichlorophenylbis, 4-hydroxyphenyl) methane; 1,1-bis(4-hydroxyphenyl)-cyclohexane; 1,1,1,3,3,3-hexafluoro-2,2-bis(4-hydroxyphenyl)propane; diphenyl-bis(4-hydroxyphenyl)methane.

Other useful bisphenols include 1,4-naphthalene diol, 2,5-naphthalene diol, bis(4-hydroxy-2-methyl-3-propylphenyl)methane, 1,1-bis(2-ethyl-4-hydroxy-5-sec.-butylphenyl)ethane, 2,2-bis(4-hydroxyphenyl)propane, 2,2-bis(4-hydroxy-2-methyl-5-tert.-butylphenyl)propane, 1,1-bis(4-hydroxy-2-methyl-5-isooctylphenyl) isobutane, bis-(2-ethyl-4-hydroxyphenyl)-4,4-di-p-tolylmethane. Still other useful bisphenols are disclosed in U.S. Pat. No. 3,030,335 and Canadian Pat. No. 576,491.

Typical monocyclic diols include hydroquinone and hydroquinones substituted with alkyl groups of 1 to 15 carbon atoms, or halogen atoms, resorcinol, unsubstituted or substituted with lower akyl groups or halogen atoms, and the like, 1,4-cyclohexanediol, 1,4-cyclohexanedimethanol, 1,4-cyclohexanediethanol, 1,4-bis(2-hydroxyethoxy)cyclohexane, 1,4-benzenedimethanol, 1,4-benzenediethanol and the like.

Illustrative examples of polyalicyclic diols include norbornylene glycol, decahydro-2,6-naphthalenedimethanol and the compounds listed in Table I of U.S. Pat. No. 3,317,466 under the heading of "Bisphenols".

Exemplary alkylene glycols include ethylene glycol, diethylene glycol, triethylene glycol, 1,2-propanediol, 1,3-propanediol, 1,4-butanediol, 2,3-butanediol, 1,5-pentanediol, 1,6-hexanediol, 1,7-heptanediol, 1,8-octanediol, 1,9-nonanediol, 1,10-decanediol, 1,12-dodecanediol, neopentyl glycol, 2,2,4-trimethyl-1,16-hexanediol and 4-oxa-2,6-heptanediol.

It will be appreciated, of course, that a variety of other diols may also be used in addition to those specified above in the preparation of the linear polyester materials used in the present invention. In general, it has been found that, to date, polyester materials of the present invention which are especially preferred due to their composite properties of redispersibility, crystallinity, low melting point and sharp melting point range are those polyesters which are prepared from aliphatic diols.

Useful dicarboxylic acids which may be used to provide the sulfonamido-free dicarboxylic acid residue $R^1$ in formula I may be selected from any of a variety of aliphatic, alicyclic, and aromatic dicarboxylic acids. Useful dicarboxylic acids as defined herein include the free acid form of these materials as well as the corresponding bifunctional equivalents of these acids including the equivalent corresponding acid anhydrides, where available. Other useful corresponding bifunctional equivalents of the free acid form of the dicarboxylic acids are the lower monohydric alcohol or phenyl esters of dicarboxylic acids and the dicarboxylic acid halides, e.g., the chlorides or bromides.

A partial list of representative sulfonamido-free dicarboxylic acids which may be employed to prepare $R^1$ in formula I include succinic acid, sebacic acid, 2-methyladipic acid, diglycolic acid, thiodiglycolic acid, fumaric acid, cyclohexane-1,3-dicarboxylic acid, cyclohexane-1,4-dicarboxylic acid, cyclopentane-1, 3-dicarboxylic acid, 2,5-norbornanedicarboxylic acid (the above-described acids being useful either as the cis or trans form), phthalic acid, isophthalic acid, terephthalic acid, t-butylisophthalic acid, phenylenediacetic acid, phenylenedipropionic acid, 2,6-naphthalenedicarboxylic acid, 1,4-naphthalenedicarboxylic acid, 1,5-naphthalenedicarboxylic acid, 1,7-naphthalenedicarboxylic acid, 4,4'-diphenic acid, 4,4'-sulfonyldibenzoic acid, 4,4'-oxydibenzoic acid, binaphthyldicarboxylic acid, 4,4'-stilbenedicarboxylic acid, and 9,10-triptycenedicarboxylic acid.

In accord with one especially useful embodiment of the present invention wherein crystalline polyesters having low, sharp melting points are provided, it has been found particularly advantageous to use as the sulfonamido-free dicarboxylic acid precursor material (from which $R^1$ in formula I is obtained) an aliphatic dicarboxylic acid such that $R^1$ in formula I has the formula $(CH_2)_n$ wherein $n$ is an integer of from 4 to about 12.

Useful dicarboxylic acids which may be employed as precursors to prepare the residue $R^3$ of formula I illustrated above (when $R^3$ is not selected from the same group as $R^1$) are dicarboxylic acids containing a disulfonamido group. Such acids typically have the structure of formula III:

III.

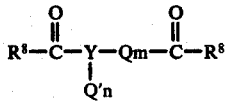

wherein $R^8$ can be, for instance, an hydroxyl group where the material is a free acid, an oxy atom linkage where the compound is an acid anhydride, a halogen atoms where the compound is in the form of an acid halide or an alkoxy group where the compound is in the form of an ester.

*m* and *n* are integers whose sum equals 1;

Q is defined by the structure of formula IV:

IV.

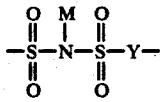

Q' is defined by the structure of formula V:

V.

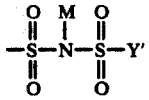

Y is an aromatic group, such as an arylene group (e.g. phenylene, naphthylene, etc.) or arylidyne group (e.g. phenyl, $C_{10}H_5$; naphthylidyne, $C_{10}H_5$; etc.);

Y' is an alkyl or aromatic group, such as an aryl, alkaryl or aralkyl group, in which each of the alkyl moieties includes from 1 through 12 carbon atoms and, preferably, from 1 through 6 carbon atoms; and M is a monovalent cation such as an alkali metal or ammonium cation.

A partial listing of representative compounds for use in forming $R^3$ or formula I (when $R^3$ is not selected from the same group as $R^1$) are: 3,3'-[(sodio-imino)disulfonyl]dibenzoic acid; 3,3'-[(potassium-imino)disulfonyl]dibenzoic acid; 3,3'-[(lithium-imino)disulfonyl]-dibenzoic acid; 4,4'-[(lithium-imino)disulfonyl]dibenzoic acid; 4,4'-[(sodio-imino)disulfonyl]-dibenzoic acid; 4,4'-[(potassium-imino)disulfonyl]dibenzoic acid; 3,4'-[(lithium-imino(disulfonyl]dibenzoic acid; 3,4'-[(sodio-imino)disulfonyl]dibenzoic acid; 5-[4-chloronaphth-1-ylsulfonyl-(sodio-imino)-sulfonyl]isophthalic acid; 4,4'-[(potassium-imino)-disulfonyl]dinaphthoic acid; 5-[p-tolylsulfonyl-((potassium-imino)-sulfonyl]isophthalic acid; 4-[p-tolyl-sulfonyl-(sodio-imino)-sulfonyl]-1,5-naphthalene-dicarboxylic acid; 5-[n-hexylsulfonyl-(lithium imino)-sulfonyl]-isophthalic acid; 2-[phenylsulfonyl-(potassium-imino)-sulfonyl]-isophthalic acid; 2-[phenylsulfonyl-(potassium-imino)-sulfonyl]-terephthalic acid and functional derivatives thereof. These and other dicarboxylic acids useful in forming repeating units $R^3$ of the crystalline polymeric polyesters used in this invention are disclosed in Caldwell and Jones U.S. Pat. No. 3,546,180, issued Dec. 8, 1970, the disclosure of which is here incorporated by reference.

The linear polyester materials used in the present invention as suggested above may be selected from a variety of well known such materials. Accordingly, extended description of the preparation thereof is unnecessary herein. In general, these linear polymers are prepared by well known condensation reaction procedures between the diol precursor materials and the dicarboxylic acid precursor materials, thereby obtaining the resultant linear polymeric esters used in the present invention.

The molecular weight of the linear polyester materials used in the present invention may vary over a considerable range. Rather than specifying a particular molecular weight range for the various polyester materials useful in the invention, it has been found more convenient in practice to identify suitable polyesters by their melting point. That is, if a particular polymer has too low a melting point, it is generally unsuitable for use because it will become tacky which leads to agglomeration or sticking together of individual toner particles at ordinary room operating temperatures. In general, useful polyester materials for the present invention should have a melting point from about 40° to about 150° C, preferably within the range of from about 60° to about 100 ° C. Polyester materials having a melting point in the aforementioned preferred range can be heat fixed to smooth-surfaced dielectric coated receiving elements as well as ordinary support surfaces, such as paper, etc., without difficulty. Higher melt point polyester materials may also be used, i.e., materials having a melting point above about 150° C; however, in this latter case one may have to be more selective as to the choice of the support to which the toner image is to be fused so that the fusing temperature employed does not damage or char the support. In addition, as described earlier herein, it is especially useful to employ a linear polyester in the present invention which has a relatively sharp melting point range, i.e., the polymer material is completely melted over a temperature range of less than about 10° C.

The melting point of useful polymers as described herein is determined by conventional melt point techniques. The melt point of crystalline polymers is determined by placing a small amount of the polymer in a capillary tube and heating the tube in a silicone oil bath. The melting point of the crystalline polymer is the point at which the crystalline polymer becomes fluid and undergoes a visual change from an opaque crystalline polymeric material to a transparent amorphous polymer material. The melting point of useful noncrystalline polyesters is defined herein as a point 25° C. above the glass transition temperature, Tg, of the polymer as measured by differential scanning calorimetry using an E. I. duPont de Nemours Co. Differential Scanning Calorimeter at a 10° C./minute temperature rise.

As indicated previously, a particularly useful feature of the preferred liquid developers of the invention is their ready heat-fixability. More specifically, it has been determined that the liquid developers of the invention, without the addition of a separate fixing component, such as a drying oil, soluble in the liquid carrier vehicle of the developer, are capable of providing liquid-developed images exhibiting good adherence to a smooth-surfaced receiving element, for example, a paper receiving element composed of an electrically conducting paper base overcoated with a smooth, dielectric resin film, such as a Butvar-coated paper (Butvar is the trademark for poly(vinyl butyral) resin sold by Schwinigan Products Corporation. These smooth-surfaced, dielectric resin-coated papers typically have a Sheffield Smoothness value of about 90 or less. In accord with the present invention, it has been found that an electrostatic charge image formed on such a dielectric-coated paper may be developed using the preferred developers of the present invention by air drying the liquid-developed toner image to remove the liquid carrier vehicle from the image areas, and moving the resultant air-dried toner image carried on the dielectric-coated paper past an infra-red heating lamp at a rate of about 5 cm./sec. to heat the toner particle image to a temperature of about 100° C. In contrast, most, if not all, prior art redispersable liquid developers either are not capable of providing images which are well fixed, i.e., tightly adhered, to a smooth-coated dielectric-coated paper (although these prior art redispersable developers may exhibit good adherence to a rough-surface paper, such as zinc oxide-coated paper), or they are able to achieve good fixing to a smooth-surface dielectric-coated paper but only because a separate, fixing component, such as a drying oil, is present solubilized in the carrier liquid of the prior art developer.

As indicated above, a molecular weight range for polyesters useful in the present invention is difficult to specify because the molecular weight of useful materials can vary considerably depending on the particular polyester being considered. However, it can be said that the polymers used in the invention advantageously contain more than three repeating units having formula I noted above and typically contain more than about 10 such units.

The following Table represents a partial listing of useful linear polyester materials which can be employed in the present invention.

TABLE 1. crystalline poly(decamethylene sebacate) having a m.p. of about 72° C.
2. crystalline poly(nonamethylene terephthalate) having a m.p. of about 85° C.
3. non-crystalline poly(ethylene terephthalate: isophthalate) having a m.p. of about 60° C.
4. crystalline poly(tetramethylene succinate:sebacate) having a variable melting point within the range of from about 65° C. to 100° C. depending on the ratio of succinate to sebacate units in this copolymer
5. crystalline poly(ethylene sebacate) having an m.p. of about 75° C.
6. crystalline poly(p-xylylene sebacate) having an m.p. of about 84° C.
7. crystalline poly(decamethylene adipate) having an m.p. of about 75° C.
8. crystalline poly(ethylene suberate) having an m.p. of about 80° C.
9. crystalline poly{decamethylene sebacate:3,3'-[(sodioimino)disulfonyl]dibenzoate} having a m.p. of about 72° C.

As described herein an especially desirable characteristic of the polyesters used in accord with a preferred embodiment of the present invention is their crystallinity. Such crystallinity is believed to contribute to the desirable properties of toner hardness, nontackiness at room temperature (i.e., 22° C), and sharp melting point. The crystallinity of the preferred polyesters used in the invention can be readily recognized using standard crystallographic identification techniques to detect the characteristic ordered structure of crystalline materials; for example, X-ray diffraction measurements. For purposes of the present invention, a polymer which does not exhibit crystallinity when examined by X-ray diffraction is considered to be non-crystalline. A convenient X-ray diffraction technique which may be used to detect crystallinity of polymeric particles consisting of taking a flat plate powder X-ray photograph of the specific polymeric particles to be measured such as described, for example, in the book entitled *Polymer Single Crystal,* by P. H. Geil, published by Interscience Publishing Co., New York, 1963.

Many of the linear polyesters useful in the invention undergo spontaneous crystallization after polymerization thereof. However, if necessary or desirable, crystallization can be induced in many polyesters which do not undergo spontaneous crystallization after the preparation thereof to render these otherwise noncrystalline polyesters more useful in the invention. Several different polymer crystallization techniques are known and any of these techniques may be employed. Further details concerning such polymer crystallization methods may be found, for example, in the book entitled *Principles of Polymer Systems* published by McGraw-Hill (1970) and authored by F. Rodrequez.

The liquid developers of the present invention, as indicated above, typically comprise a dispersion of the linear polyester tone particles in a suitable carrier liquid. A common method of preparing such a liquid developer is to first prepare a so-called "concentrate". One method of preparing such a concentrate is by solvent milling. A quantity of the polyester material, as described above, is dissolved in a suitable solvent, such as dichloromethane, and the solution placed in a ball mill. Pigments and other additives which may be desirable or necessary depending on the particular end use of a given developer composition may be added to the mix and the whole mix milled using stainless steel milling beads about 0.3 cm in diameter for a suitable time, typically on the order of about 1 or 2 days. The polymer-solvent mixture is then separated from the milling beads and the solvent, such as dichloroethane, removed. The resultant dry polymer-containing material may then be ground and ball milled in a small amount of a suitable liquid carrier vehicle in which the polyester is insoluble to reduce the particle size of the polymeric toner material to a size of less than about 5 microns, typically within the range of from about 0.01 to about 1.0 micron. The resultant composition represents a so-called developer "concentrate".

A working strength liquid developer is typically prepared from the above-described concentrate by mixing an amount of concentrate together with an amount of suitable liquid carrier vehicle to provide a developer containing the desired amount of toner particles dispersed in the liquid carrier vehicle. In general, useful working strength developers of the present invention contain from about 0.05 to about 15% by weight of polymeric toner particles and from about 99.95 to about 85% by weight of liquid carrier vehicle. Best results are generally obtained wherein the toner particles are present in the range of from about 0.1 to about 3% by weight and the liquid carrier vehicle is present in the range of from about 99.9 to about 97% by weight of the resultant developer composition.

As indicated above, suitable liquid carrier vehicles useful in the developer compositions of the present invention may be selected from a variety of liquid materials. These materials should be electrically insulating and have a fairly low dielectric constant. In addition, the carrier vehicle should be selected as a liquid with respect to which the particular linear polyester contained in the toner particles is physically inert. The term "physically inert", as used herein, as suggested above, is defined to mean that the toner particles contained in the liquid developers of the invention are not soluble in or swellable or softenable by the liquid carrier vehicle of the developer. In general, useful carrier liquids should have a dielectric constant of less than about 3, and a volume resistivity greater than about $10^{10}$ ohm/cm. Suitable carrier liquids include halogenated hydrocarbon solvents, for example, fluorinated lower alkanes, such as trichloromonofluoromethane, trichlorotrifluoroethane, etc., having a boiling range typically from about 2° to about 55° C. Other hydrocarbon solvents are useful such as isoparaffinic hydrocarbons having a boiling range of from about 145° to about 185° C such as Isopar G (A trademark of the Exxon Corp.) or cyclohydrocarbons such as cyclohexane. Additional carrier liquids which may be useful in certain situations include polysiloxanes, odorless mineral spirits, octane, and the like. As noted above, to insure the proper solvent properties exist between the carrier vehicle and the polyester used in the toner particles contained in the developer of the present invention, it will be appreciated that the particle liquid carrier vehicle selected must depend in large part on the solvent properties of the particular polyester material used in the toner particle.

Although it is possible to use the liquid developers of the present invention without further addenda such as charge control agents or colorants, it is often desirable to incorporate such materials. For example, it is usually desirable to incorporate a colorant such as a dye or pigment in the developer to provide suitable image density. Of course, if a colorless image is desired as may be the case in certain situations; for example, the developer of the invention may be used to form a colorless hydrophobic image in a lithographic printing process, it may be unnecessary to add any colorant or other additives. In such case the resultant developer composition consists essentially of the liquid carrier vehicle and the above-described polyester toner particle. Generally, however, suitable colorants are desirable for use in the liquid developers of the present invention and such colorants may be selected from a variety of known dyes or pigments. Although useful results may be obtained from virtually any of a wide variety of known dyes or pigment materials. Particularly good results are obtained, for example, by using various kinds of carbon black pigments. However a variety of other dyes and pigments may also be used, a partial representative list thereof may be found, for example, in *Research Disclosure,* Vol. No. 109, May, 1973, in an article entitled "Electrophotographic Elements, Materials and Processes" appearing at page 61, in paragraph IX (C) (2thereof.

As suggested hereinabove, the colorant when employed in the liquid developer of the present invention typically may be incorporated in the developer by admixture of the colorant together with the linear polyester during the initial preparative stages of the developer, for example, when the developer concentrate is prepared. Typically, when the developers of the present invention are prepared using the so-called concentrate technique as described hereinabove, the amount of colorant which may be employed may vary widely depending upon the desired optical density of the developed image, the particular colorant or colorants employed, and the like. Typically, one generally employs in the preparation of a concentrate an amount of colorant within the range of from about 0 to about 200 weight percent based on the weight of the linear polyester used in preparing the concentrate. A final working strength developer of the present invention which, as described hereinabove, typically contains from about 85 to about 99.95% liquid carrier vehicle and from about 0.05 to about 15 weight percent of toner particles will generally contain an amount of colorant, if a colorant is used in the developer, within the range of from about 0.01 to about 5 weight percent based on the total weight of the working strength developer including carrier liquid, toner particles, and any other additives which may be present. In general, it is believed that most colorants incorporated in the developers of the present invention are contained dispersed or encapsulated within the linear polyester which forms the insoluble toner particles used in the liquid developers of the present invention.

In addition to colorants, the developers of the present invention may contain, if desired, various charge control agents to enhance the charge polarity uniformity of the toner particles dispersed therein, i.e., to provide a developer containing either predominantly positively charged or predominantly negatively charged toner particles. Such charge control agents are not necessary but are often useful to eliminate or at least substantially reduce possible bicharging of the toner particles within the developer composition, i.e., to prevent or at least substantially reduce the presence of positively charged particles when negatively charged particles are desired or, in the alternative, to reduce or prevent the occurrence of a large number of negatively charged toner particles in the situation where it is desired to obtain a developer containing essentially positively charged particles.

Various such charge control agents have been described heretofore in the liquid developer art. An extensive discussion thereof is deemed unnecessary herein. Examples of such charge control agents may be found, for example, in U.S. Pat. No. 3,788,995, issued Jan. 29, 1974 which described various polymeric charge control agents such as terpolymers, for example, a styrene-lauryl methacrylate-sulfoethyl methacrylate terpolymer. These polymeric charge control agents are typically substantially soluble in the liquid carrier vehicle or at least readily dispersible therein so that there is no problem of these materials settling out of the developer. Various non-polymeric charge control agents may also be employed such as for example the various metal salts described, for example, in Beyer U.S. Pat. No. 3,417,019, issued Dec. 17, 1968. Other charge control agents known in the liquid developer art may also be employed. Although the amount of such charge control agents, if they are used, will vary depending upon the particular charge control agent and its particular relationship to a given toner particle and liquid carrier vehicle, it is usually desirable to employ an amount of charge control agent within the range of from about 0.1 to about 2.0 weight percent based on the total weight of a working strength liquid developer composition. Although a charge control agent, if it is used, may be incorporated in the liquid developer during the preparation of a so-called developer concentrate, it is more frequently the case that the charge control agent is incorporated in the final working strength developer simply by dissolving or dispersing the charge control agent in the liquid carrier vehicle at the time the developer concentrate is combined with the liquid carrier vehicle to form a working strength developer.

The following examples are included for a further understanding of the invention:

EXAMPLE 1

A particulate composition was prepared by dissolving 18 parts (by weight) of the linear crystalline polyester poly(decamethylene sebacate) having a melting point of 72° C. in 73 parts (by weight) of dichloromethane and then adding with agitation 9 parts (by weight) of carbon black (purchased from Columbian Carbon Co. under the trademark Peerless 155) followed by ball milling of the composition for 24 hours using ⅛ inch steel balls. The carbon-polymer mixture is then separated from the milling beads and the dichloromethane removed. The resultant dry, particulate composition was then ground and ball-milled in a small amount of Isopar G® to reduce the particle size to 2 microns or less. The resultant reduced particle size composition containing Isopar G® constituted a liquid developer concentrate and contained about 90 percent (by weight) Isopar G®.

A working strength liquid developer was then prepared by mixing enough of the above-described concentrate in Isopar G® to yield a carbon content of 0.5g/liter. The Isopar G® also contained 0.5g/liter of a styrene-lauryl methacrylate-sulfoethyl-methacrylate terpolymer as charge control agent. When used to develop a negative electrostatic charge pattern formed on an organic photoconductive composition coated on a flexible conductive film support in a conventional liquid development electrophotographic process such as described in Metcalfe et. al. U.S. Pat. No. 2,907,674 this developer containing positively-charged toner particles provided good quality images. After standing a few weeks, the toner particles that had settled out of the developer suspension were readily redispersed using a minimal amount of agitation by merely inverting the bottle in which the developer was stored. The resultant redispersed developer, when used in an electrophotographic process identical to that in which the original developer was used, produced the same developed image quality as the original developer.

EXAMPLE 2

A particulate composition was prepared as described in Example 1 and then jet pulverized to a 10–20 micron particle size. This material was then ball-milled in a small amount of Isopar G® (also containing 0.6g/liter of styrene-lauryl methacrylatesulfoethylmethacryl terpolymer charge control agent) to reduce the particle size to 2 microns or less. Additional Isopar G® was then added and the resultant positively-charged liquid developer contained about 0.15 weight percent toner particles and about 99.85 percent Isopar G®. This developer was used in an electrophotographic process as described in Example 1 to develop negatively-charged electrostatic image patterns, it produced images of excellent quality. Toner particles which settled out of the developer when the developer was allowed to stand during a period of little or no usage could be easily redispersed by agitation without affecting the image quality.

EXAMPLE 3

The liquid developer of this example was prepared in a manner similar to Example 1 except the Monastral Blue pigment was utilized in place of the carbon black pigment. Excellent quality electrophotographic images were obtained when the developer of this example was used in a conventional electrophotographic imaging process as described in Example 1.

EXAMPLE 4

The liquid developer prepared in this example was prepared in a manner similar to Example 2 except that a wetting agent, Aerosol TR (a trademark of American Cyanamid Co. for tridecyl sodium sulfosuccinate), was used in place of the terpolymer charge control agent. The resultant liquid developer contained negatively charged toner particles and was utilized in an electrophotographic process to develop positively-charged electrostatic image patterns.

EXAMPLE 5

A liquid developer toner mixture was prepared by dissolving 20 parts (by weight) of the linear crystalline polyester poly(nonamethylene terephthalate) having a m.p. of about 85° C. in 70 parts (by weight) of dichloromethane and adding thereto 10 parts (by weight) of carbon black pigment (purchased from Cabot Carbon Co. under the trademark of Regal ® 300R). The mixture was then ball-milled for 24 hours, precipitated in cyclohexane, filtered and then dried. The dry particles were then milled in a small amount of Isopar G® to disperse the particles. The resulting concentrate was then diluted to form a working strength developer by adding about 13.5 gms. of the above-described mixture to about one liter of Isopar G®. The resulting liquid developer contained about 0.15 weight percent of toner particles dispersed in about 99.85 weight percent Isopar G®. No charge control agent was used in the developer of this example. The developer of this example provided excellent quality images when used in a conventional electrophotographic process as described in Example 1. The toner was easily redispersible as in Example 1.

EXAMPLE 6

A liquid developer was prepared as described in Example 5 except that a noncrystalline, linear polymer of poly(ethylene terephthalate:isophthalate) having a melting point of about 60° C. was used as the linear polyester. When used as a developer in a conventional electrophotographic process as described in Example 1, high-density, good quality images were obtained.

EXAMPLE 7

A liquid developer was prepared as described in Example 5 except that poly(ethylene sebacate) was used as the linear crystalline polyester. Excellent quality images were also obtained with this developer when employed in a conventional electrophotographic process as described in Example 1.

EXAMPLE 8

A dry particulate composition was prepared by dissolving 10 g of the linear, crystalline polyester poly{• decamethylene sebacate:3,3'-[(sodio-imino)disulfonyl]-dibenzoate} in methylene chloride and adding thereto 5.0 g Regal ® 300R carbon black pigment and 0.75 g Monastral blue pigment; the mixture was then ball-milled for 24 hours and then precipitated in methanol, filtered and dried.

4.5g. of the above-noted dry, particulate composition was then ground further in about 45 ml of Isopar G® containing about 0.6g/liter of the terpolymer poly(styrene-co-lauryl methacrylate-co-sulfethylmethacrylate) to form a liquid developer concentrate.

The working developer was then prepared by adding about 7.6 g of the above-noted concentrate to about 600 ml Isopar G®. The developer of this example provided good quality liquid developed images when used in a conventional electrophotographic process as described in Example 1. The toner particles contained in this liquid developer were easily redispersible as in Example 1.

EXAMPLE 9

The redispersibility characteristics of various other resins were tested according to the following procedure. Each resin was ball-milled for at least 24 hours in a small amount of Isopar G® to disperse the resin particles and reduce the particle size to 2 microns or less. Additional Isopar G® was then added to make a liquid developer containing about 0.15 weight percent resin particles and 99.85 percent Isopar G®. The redispersibility of the resin particles was then tested according to the procedure described in the specification above.

The following crystalline polyesters were tested: poly(pentamethylene glutarate), m.p. 25° C; poly(neopentyl adipate), soft at room temperature; and poly(ethylene terephthalate), m.p. 230° C. The poly(pentamethylene glutarate) and poly(neopentyl adipate) were not redispersible. The poly(ethylene terephthalate) was redispersible, however, it was not easily fused because of its high melting point and thus not a practical resin. The following non-crystalline polyesters were tested: Beckosol, an alkyd resin phthalic acid modified soybean oil sold by Reichold Chemicals, Inc., White Plains, New York; and various polycarbonates. The Beckosol alkyd resin was not redispersible. Although redispersible, the polycarbonates were unusable as toners because of their high softening temperatures, in excess of 200° C, which made them impractical for fusing.

Other resins tested for redispersibility included the following Amberol resins, maleic anhydride rosin modified resins sold by Rohm and Haas, Philadelphia, Pa.; Amberol 926, Amberol 820 and Amberlac D-96, which have melting points in the range of 80° to 145° C. None of these resins were found to be redispersible.

The invention has been described in detail with particular reference to certain preferred embodiments thereof, but it will be understood that variations and modifications can be effected within the spirit and scope of the invention.

I claim:

1. An electrographic liquid developer composition comprising a mixture of electrostatically-attractable, heat-fixable redispersible toner particles in an electrically insulating liquid carrier having a volume resistivity greater than $10^{10}$ ohm-cms. and a dielectric constant less than about 3.0, said toner particles (a) present in an amount of from about 0.05 to about 15 weight percent of said developer composition, (b) having a melting point in the range of from about 40° to about 150° C, and (c) comprising, in an amount greater than about 0.05 weight percent of said developer composition, a linear polyester physically inert with respect to said carrier liquid, said polyester having the formula $$\left(O-R-O-\overset{O}{\overset{\|}{C}}-R^1-\overset{O}{\overset{\|}{C}}\right)_{100-X}\left(O-R^2-O-\overset{O}{\overset{\|}{C}}-R^3-\overset{O}{\overset{\|}{C}}\right)_X$$

wherein X represents a mole percentage value within the range of 0 to 100 mole percent; R and $R^2$, which may be the same or different, represent a member of the group selected from the divalent residue of an aliphatic, alicyclic, or aromatic diol upon removal of the two hydroxy groups from said diol; $R^1$ is a member selected from the group consisting of the divalent residue of a sulfonamido-free aliphatic, alicyclic or aromatic dicarboxylic acid upon removal of the two carboxy groups from said acid; and $R^3$ represents (i) a member selected from the same group as $R^1$ and may be the same as or different from $R^1$ or (ii) the divalent residue of a disulfonamido group-containing aromatic dicarboxylic acid upon removal of the two carboxyl groups from said acid, said disulfonamido group having a monovalent cation on the amido nitrogen atom thereof.

2. An electrographic liquid developer composition as defined in claim 1 wherein $R^3$ is a member selected from the same group as $R^1$.

3. An electrographic liquid developer composition comprising a mixture of electrostatically-attractable, heat-fixable redispersible toner particles in an electrically insulating liquid carrier having a volume resistivity greater than $10^{10}$ ohm-cms. and a dielectric constant less than about 3.0, said toner particles (a) present in an amount of from about 0.05 to about 15 weight percent of said developer composition, (b) having a melting point in the range of from about 40° to about 150° C, and (c) comprising, in an amount greater than about 0.05 weight percent of said developer composition, a linear crystalline polyester inert with respect to said carrier liquid, said polyester having the formula $$\left(O-R-O-\overset{O}{\overset{\|}{C}}-R^1-\overset{O}{\overset{\|}{C}}\right)_{100-X}\left(O-R^2-O-\overset{O}{\overset{\|}{C}}-R^3-\overset{O}{\overset{\|}{C}}\right)_X$$

wherein X represents a mole percentage value within the range of 0 to 100 mole percent; R and $R^2$, which may be the same or different, represent a member of the group selected from the divalent residue of an aliphatic, alicyclic, or aromatic diol upon removal of the two hydroxy groups from said diol; and $R^1$ and $R^3$, which may be the same or different, represent a member selected from the group consisting of the divalent residue of a sulfonamido-free aliphatic, alicyclic or aromatic dicarboxylic acid upon removal of the two carboxyl groups from said acid.

4. An electrographic liquid developer composition as defined in claim 3 wherein said toner particles have a melting point within the range of from about 60° to about 100° C.

5. An electrographic liquid developer composition as defined in claim 3 wherein said crystalline polyester is selected from the group consisting of poly(decamethylene sebacate), poly(nonamethylene terephthalate), poly(tetramethylene succinate:sebacate), poly(ethylene sebacate), poly(p-xylylene sebacate), poly(decamethylene adipate) and poly(ethylene suberate).

6. An electrographic liquid developer composition comprising a mixture of electrostatically-attractable redispersible toner particles in an electrically insulating liquid carrier having a volume resistivity greater than $10^{10}$ ohm-cms. and a dielectric constant less than about 3.0, said toner particles (a) present in an amount of from about 0.1 to about 3 weight percent of said developer composition and (b) comprising, in an amount greater than about 0.05 weight percent of said developer composition, a linear polyester physically inert with respect to said carrier liquid, said polyester having the formula $$\left(O-R-O-\overset{O}{\overset{\|}{C}}-R^1-\overset{O}{\overset{\|}{C}}\right)_{100-X}\left(O-R^2-O-\overset{O}{\overset{\|}{C}}-R^3-\overset{O}{\overset{\|}{C}}\right)_X$$

wherein X represents a mole percentage value within the range of 0 to 100 mole percent; and R and $R^2$, which may be the same or different, represent a member of the group selected from the divalent residue of an aliphatic, alicyclic, or aromatic diol upon removal of the two hydroxy groups from said diol; and $R^1$ and $R^3$, which may be the same or different, represent a member selected from the group consisting of the divalent residue of a sulfonamido-free aliphatic, alicyclic or aromatic dicarboxylic acid upon removal of the two carboxy groups from said acid, said toner particles contained in said developer composition having an average particle size within the range of from about 0.1 to about 10 microns and having a melting point within the range of from about 60° to about 100° C., and comprising from about 0.1 to about 33 percent by weight of a colorant.

7. An electrographic liquid developer composition as defined in claim 6 wherein said linear polyester is selected from the group consisting of poly(decamethylene sebacate), poly(nonamethylene terephthalate), poly(ethylene terephthalate:isophthalate), poly(tetramethylene succinate:sebacate), poly(ethylene sebacate), poly(p-xylylene sebacate), poly(decamethylene adipate) and poly(ethylene suberate).

8. An electrographic liquid developer composition comprising a mixture of electrostatically-attractable redispersible toner particles in an electrically insulating liquid carrier having a volume resistivity greater than $10^{10}$ ohm-cms. and a dielectric constant less than about 3.0, said toner particles (i) present in an amount of from about 0.1 to about 3 weight percent of said developer composition, (ii) having a melting point within the range of from about 60° to about 100° C. and (iii) comprising, in an amount greater than about 0.05 weight percent of said developer composition, a linear crystalline polyester physically inert with respect to said carrier liquid, said polyester having the formula $$\left(O-R-O-\overset{O}{\overset{\|}{C}}-R^1-\overset{O}{\overset{\|}{C}}\right)_{100-X}\left(O-R^2-O-\overset{O}{\overset{\|}{C}}-R^3-\overset{O}{\overset{\|}{C}}\right)_X$$

wherein X represents a mole percentage value within the range of 0 to 100 mole percent; R and $R^2$, which may be the same or different, represent a divalent residue of a aromatic diol; and $R^1$ and $R^3$, which may be the same or different, represent a divalent residue of a sulfonamido-free aliphatic dicarboxylic acid.

9. An electrographic liquid developer composition comprising a mixture of electrostatically-attractable redisersible toner particles in an electrically insulating liquid carrier having a volume resistivity greater than $10^{10}$ ohm-cms. and a dielectric constant less than about 3.0, said toner particles (i) present in an amount of from about 0.1 to about 3 weight percent of said developer composition, (ii) having a melting point within the range of from about 60° to about 100° C, and (iii) comprising, in an amount greater than about 0.05 weight percent of said developer composition, a linear polyester physically inert with respect to said carrier liquid, said polyester having the formula $$\left(O-R-O-\overset{O}{\overset{\|}{C}}-R^1-\overset{O}{\overset{\|}{C}}\right)_{100-X}\left(O-R^2-O-\overset{O}{\overset{\|}{C}}-R^3-\overset{O}{\overset{\|}{C}}\right)_X$$

wherein X represents a mole percentage value within the range of 0 to 100 mole percent; R and $R^2$, which may be the same or different, represent a divalent residue of an alkylene glycol upon removal of the two hydroxy groups from said glycol and $R^1$ and $R^3$, which may be the same or different, represent the divalent residue of a sulfonamido-free aliphatic dicarboxylic acid.

10. In an electrographic development process wherein an electrostatic charge pattern carried on a dielectric substrate is developed into a visible image by applying an electrographic liquid developer composition to said charge pattern, the improvement which comprises applying, as said liquid developer composition to said charge pattern, a composition comprising a mixture of electrostatically-attractable, heat-fixable redispersible toner particles in an electrically insulating liquid carrier having a volume resistivity greater than $10^{10}$ ohm-cms. and a dielectric constant less than about 3.0, said toner particles (a) present in an amount of from about 0.05 to about 15 weight percent of said developer composition, (b) having a melting point in the range of from about 40° to about 150° C, and (c) comprising, in an amount greater than about 0.05 weight percent of said developer composition, a linear polyester physically inert with respect to said carrier liquid, said polyester having the formula $$\left(O-R-O-\overset{O}{\overset{\|}{C}}-R^1-\overset{O}{\overset{\|}{C}}\right)_{100-X}\left(O-R^2-O-\overset{O}{\overset{\|}{C}}-R^3-\overset{O}{\overset{\|}{C}}\right)_X$$

wherein X represents a mole percentage value within the range of 0 to 100 mole percent; R and $R^2$, which may be the same or different, represent a member of the group selected from the divalent residue of an aliphatic, alicyclic, or aromatic diol upon removal of the two hydroxy groups from said diol; $R^1$ is a member selected from the group consisting of the divalent residue of a sulfonamido-free aliphatic, alicyclic or aromatic dicarboxylic acid upon removal of the two carboxyl groups from said acid; and $R^3$ represents (i) a member selected from the same group as $R^1$ and may be the same as or different from $R^1$ or (ii) the divalent residue of a disulfonamido group-containing aromatic dicarboxylic acid upon removal of the two carboxyl groups from said acid, said disulfonamido group having a monovalent cation on the amido nitrogen atom thereof.

* * * * *

UNITED STATES PATENT AND TRADEMARK OFFICE

CERTIFICATE OF CORRECTION

PATENT NO. : 4,052,325

DATED : October 4, 1977

INVENTOR(S) : Domenic Santilli

It is certified that error appears in the above-identified patent and that said Letters Patent are hereby corrected as shown below:

Column 7, line 30, "moncyclic" should read --monocyclic--.

Column 9, line 12, "atoms" should read --atom--.

Column 9, line 33, after "phenyl," delete "$C_{10}H_5$;".

Column 9, line 33, after "naphthylidyne" delete "$C_{10}H_5$;".

Column 10, line 65, "Schwinigan" should read --Shawinigan--.

Column 11, line 65, "consisting" should read --consists--.

Column 13, line 18, "particle" should read --particular--.

Column 13, line 48, "(2thereof" should read --(2) thereof--.

Column 16, line 57, "poly{•" should read --poly{:--.

Column 19, line 52, "a" should read --an--.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*